United States Patent [19]

Persyk

[11] Patent Number: 4,649,268

[45] Date of Patent: Mar. 10, 1987

[54] IMAGING DYNODES ARRANGEMENT

[75] Inventor: Dennis E. Persyk, Barrington, Ill.

[73] Assignee: Siemens Gammasonics, Inc., Des Plaines, Ill.

[21] Appl. No.: 587,799

[22] Filed: Mar. 9, 1984

[51] Int. Cl.[4] ..... H01J 40/14

[52] U.S. Cl. ..... 250/207; 313/105 R

[58] Field of Search ..... 250/207, 213 VT; 313/103 R, 103 CM, 104, 105 R, 105 CM, 523, 528, 529, 532–537

[56] References Cited

U.S. PATENT DOCUMENTS

| | | | |
|---|---|---|---|
| 3,939,374 | 2/1976 | Schagen et al. | 313/534 |
| 3,939,375 | 2/1976 | Schagen et al. | 313/105 R |
| 4,112,326 | 9/1978 | Faulkner | 250/207 |
| 4,143,291 | 3/1979 | Morales | 313/105 R |

FOREIGN PATENT DOCUMENTS 543106 2/1942 United Kingdom .

*Primary Examiner*—David C. Nelms

*Attorney, Agent, or Firm*—Mark H. Jay

[57] ABSTRACT

An imaging dynodes arrangement for an electron multiplier, which comprises a first and a second imaging dynodes having dynode cones with a cone tip and a cone base, said dynode cones being connected with each other such that they form free cavities therebetween. Furthermore, there are needle-shaped extraction points arranged at the cone tips of at least the dynode cones of the second imaging dynode. The second imaging dynode is mounted beneath the first imaging dynode in a staggered position such that the cone tips of the dynode cones of the second imaging dynode are seated beneath the cavities of the first imaging dynode, directing the needle-shaped extraction points closely to the cavities. In a preferred embodiment the needle-shaped extraction points protrude into the cavities.

8 Claims, 7 Drawing Figures

IMAGING DYNODES ARRANGEMENT

BACKGROUND OF THE INVENTION

1. Field of the Invention

The present invention relates to an imaging dynodes arrangement for an electron multiplier. In particular, it relates to an imaging dynodes arrangement which can be utilized in a single tube scintillation gamma camera.

2. Description of the Prior Art

An imaging dynodes arrangement for an electron multiplier which comprises at least a first and a second imaging dynodes, having dynode cones with a dynode tip and a dynode base, is for example described in the brochure "Nucleonics Data" pages 1-22, issued by Johnston Laboratories, Cockeysville, Md. 21030 under the number JLI-605. As can particularly be seen from page 3 of this brochure, the first and second imaging dynodes are arranged parallel to each other in staggered positions such that the cone tips of the dynode cones of the second imaging dynodes are always in a position beneath the free cavities between neighboring dynode cones of the first imaging dynode. Furthermore, each first and second imaging dynodes are separated from each other by a mesh of guard plates. Such a prior art imaging dynodes arrangement has a considerably non-uniform charge spread and the dynodes have a relatively low gain.

SUMMARY OF THE INVENTION

1. Objects

It is an object of this invention to provide an improved imaging dynodes arrangement which has a uniform charge spread and in which the dynodes have an optimum high gain.

It is another object of this invention to provide a single tube scintillation gamma camera with an imaging dynodes arrangement, which has the aforementioned improved characteristics.

2. Summary

According to this invention, an imaging dynodes arrangement is provided which comprises a first and a second imaging dynode. Each dynode has dynode cones with a cone tip and a cone base, and the cones of each dynode are connected to each other such that they form free cavities therebetween. At the cone tips of at least the dynode cones of the second imaging dynode there are arranged needle-shaped extraction points. The second imaging dynode is mounted beneath the first imaging dynode in a staggered position, such that the cone tips of the dynode cone of the second imaging dynode are seated beneath the cavities of the first imaging dynode, directing the needle-shaped extraction points closely to the cavities.

In contrast to the prior art according to this invention at least the dynode cones of the second imaging dynode comprise needle-shaped extraction points that are seated close to the free cavities between the dynode cones of the first imaging dynode. This provides a relatively high electric field to aid secondary electron extraction from one imaging dynode (i.e. the first imaging dynode) to the next one (i.e. the second imaging dynode). The electron transfer is greatly enhanced. Furthermore, the charge spread is uniform and the dynodes have a high gain.

In a preferred embodiment of the invention the needle shaped extraction points of the second imaging dynode protrude into the cavities of the first imaging dynode.

Advantageously, an imaging dynode arrangement according to this invention is part of a photomultiplier tube with a photocathode and an anode, wherein the imaging dynode arrangement is placed between both electrodes.

It is also advantageous to use an imaging dynodes arrangement according to this invention in a scintillation camera. The camera has a scintillation crystal, a number of photo multiplier tubes mounted behind a scintillation crystal, a photocathode and an anode, and the imaging dynodes arrangement is placed between both electrodes.

It is further advantageous, to utilize an imaging dynodes arrangement in a single tube gamma camera comprising a scintillation crystal, a photocathode associated with the scintillation crystal, and an anode, wherein the imaging dynodes arrangement is placed between both electrodes.

The foregoing and other objects, features and advantages of the invention will be apparent from the following more particular description of preferred embodiments of the invention, as illustrated in the accompanying drawings.

BRIEF DESCRIPTION OF THE DRAWINGS

In the drawings.

Same reference numerals are used for corresponding parts throughout the drawing.

DETAILED DESCRIPTION OF THE PREFERRED EMBODIMENT

Figure 1:
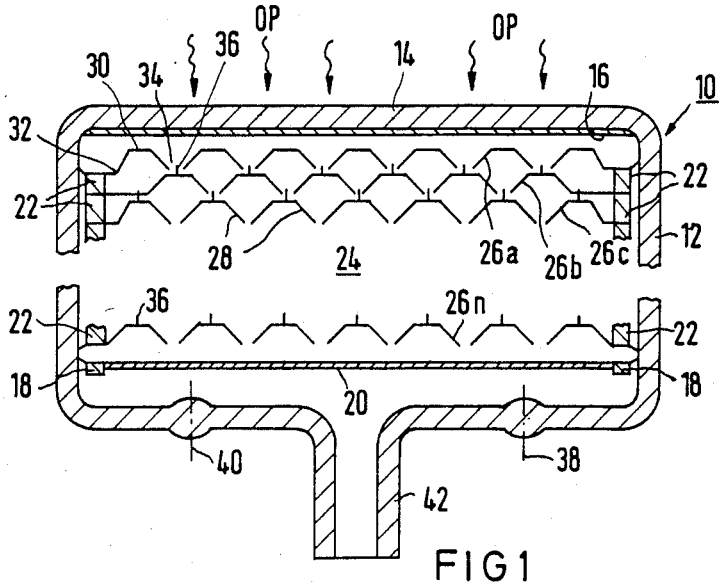
FIG. 1 is a cross section of a photomultiplier tube comprising an imaging dynodes arrangement according to the invention.

FIG. 1 illustrates a photomultiplier tube 10 having a glass envelope 12 (e.g., Kovar-sealing glass envelope). The glass envelope 12 comprises an optical window 14 for optical photons generally designated by OP. The inner surface of the optical window 14 bears a photocathode 16 (e.g., K2CsSb with pre-evaporated layer of Sb). Inside the glass envelope 12 is also arranged, e.g., by means of insulator elements 18, a position/centroid-determining anode 20.

Furthermore, in the glass envelope 12 between photocathode 16 and anode 20 there is also mounted, e.g., by means of insulator stacking elements 22, an imaging dynodes arrangement 24 according to the invention.

The imaging dynodes arrangement 24 comprises a number n (e.g., n=3−20) of imaging dynodes 26a–26n. Each imaging dynode 26a–26n contains dynode cones 28 with a dynode tip 30 and a dynode base 32. The dynode cones 28 of each imaging dynode 26a–26n are connected with each other such that they form free cavities 34 therebetween.

At least each dynode cone 28 of imaging dynodes 26b–26n comprises a needle-shaped extraction point 36 arranged at the cone tip 30. In the embodiment of FIG. 1 (and also in the embodiments of FIGS. 2–7) the dynodes cones 28 of the first imaging dynode 26a does not comprise needle-shaped extraction points. This is, however, only a matter of design. It is understood, that, if desired, also these cones may be provided with a needle-shaped extraction point.

Further, according to this invention, the imaging dynodes 26a to 26n are arranged in a symmetrical pattern one beneath the other in staggered positions such that the cone tips 30 of the dynode cones 28 of one imaging dynode are always seated beneath the free cavities 34 of the preceding imaging dynode, thereby directing the needle-shaped extraction points 36 closely to the cavities 34. In the embodiment of FIG. 1 (and also in the embodiments of FIGS. 2–7) each needle-shaped extraction point 36 protrudes into a free cavity 34.

As already mentioned before, the described imaging dynodes arrangement 24 provides a relatively high electric field to aid secondary electron extraction from one imaging dynode to the next one. The electron transfer is greatly enhanced.

For the voltage supply of the imaging dynodes 26a–26n, the photocathode 16 and the anode 20 (and for other internal processing elements, if desired) the photomultiplier tube 10 comprises lead connections 38 and 40 (e.g., 21–35 Kovar Leads) which connect the aforementioned inner elements with an outer (not shown) voltage supply. An exhaust tubulation of the glass envelope 12 is generally designated by 42.

In practice, the outside diameter of the photomultiplier tube 10 can range up to, for example, 8 inches, for a planar tube window. The diameter can be larger for curved tube windows.

Figure 2:
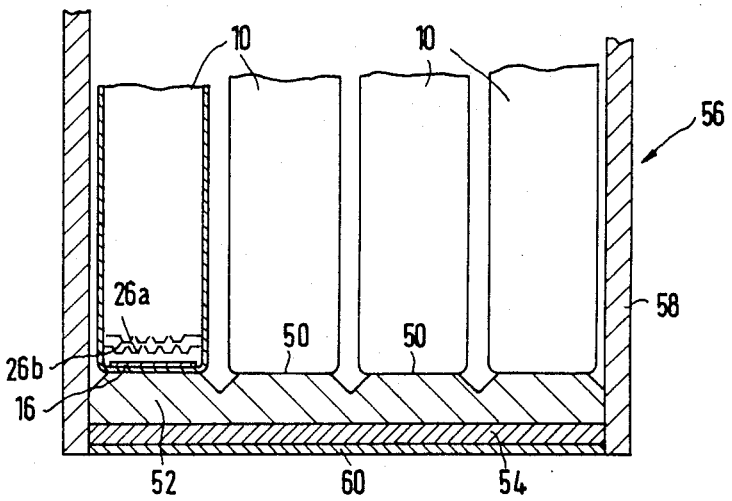
FIG. 2 is a cross section of a camera head of a gamma scintillation camera comprising a number of photomultiplier tubes according to FIG. 1.

As illustrated in FIG. 2, a certain number, for example up to twelve photomultiplier tubes 10, can be mounted on the pads 50 of the light conductor 52 of a scintillation crystal 54 of a conventional Anger scintillation gamma camera head 56. By this measure the total number (37–75) of photomultiplier tubes of a conventional Anger scintillation gamma camera can be reduced, without losses in performance. Due to this the camera head becomes less expensive. In FIG. 2 the housing of the Anger scintillation gamma camera head 56 is generally designated by 58. The scintillation crystal 54 also comprises an aluminum cover 60.

Figure 7:
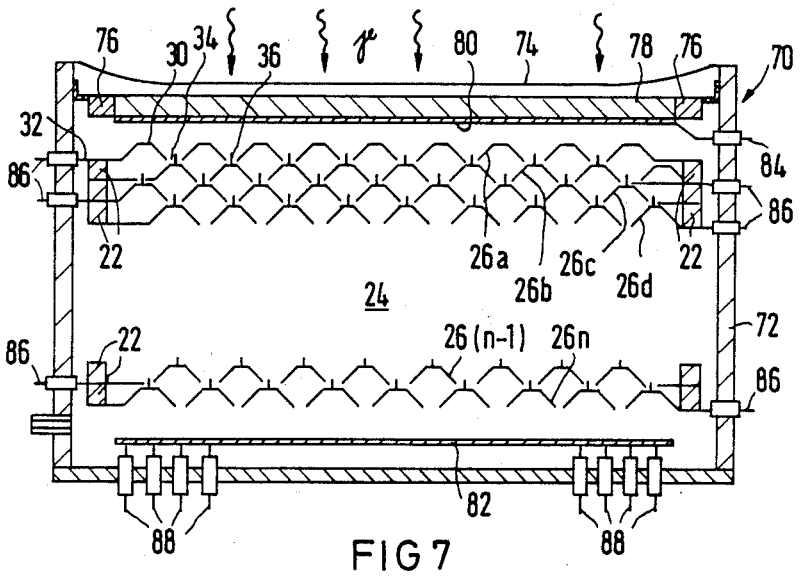
FIG. 7 is a cross section of a single tube scintillation gamma camera which comprises an imaging dynodes arrangement according to the invention.

The imaging dynodes arrangement 24 according to this invention can also become portion of a single tube scintillation gamma camera 70, as illustrated for example in FIG. 7.

The single tube scintillation gamma camera 70 comprises a housing 72 having a thin stainless input window 74 for gamma rays. Behind the input window 76 is mounted by means of spot welded insulator tabs 74 a scintillation crystal 78. A photocathode 80 is evaporated on the scintillation crystal 78 as indicated in FIG. 7. The anode is generally designated by 82. The photocathode 80 comprises a lead 84 for voltage supply. The leads 86 are designated for voltage supply of imaging dynodes 26a–26n and the leads 88 are the anode leads of anode 82.

The single tube scintillation gamma camera 70 may again comprise between 3–20 imaging dynodes. The overall tube diameter may lie in the range of 5 inches to 25 inches. The dynodes 26a–26n will be fairly rigid with the formed indentations. However, on larger diameters (e.g.,>8 inches) a stiffening ring (not shown) may be needed to be spot-welded to the circumference. FIGS. 3–6 illustrate embodiments of dynodes which have different cone shapes.

Figure 3:
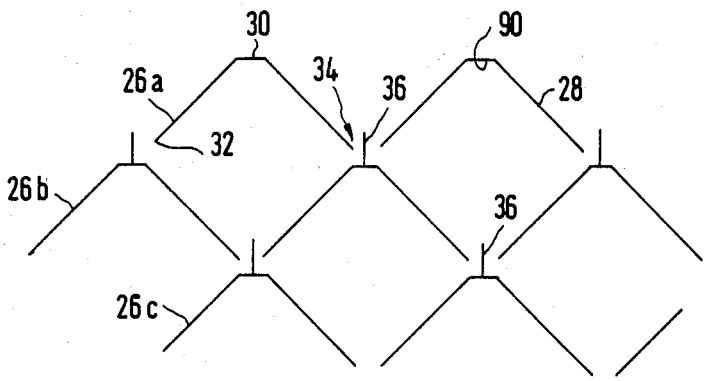
FIG. 3 is a schematic diagram of a first embodiment of an imaging dynodes arrangement according to the invention.

The dynodes of the arrangement of FIG. 3 equal the dynodes 26a–26n which are utilized in the photomultiplier tubes of FIGS. 1 and 2 and in the single tube scintillation camera of FIG. 7. These dynodes 26a–26n have a flat area 90 as cone tip 30.

Figure 4:
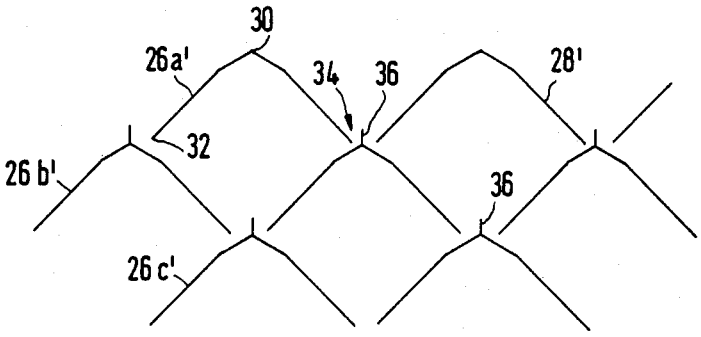
FIG. 4 is a schematic diagram of a second embodiment of an imaging dynodes arrangement according to the invention.

In the arrangement of FIG. 4 the cones 28' of dynodes 28a'–26n' have cone tips 30 which merge under a flatter angle than the angle of the cone shells.

Figure 5:
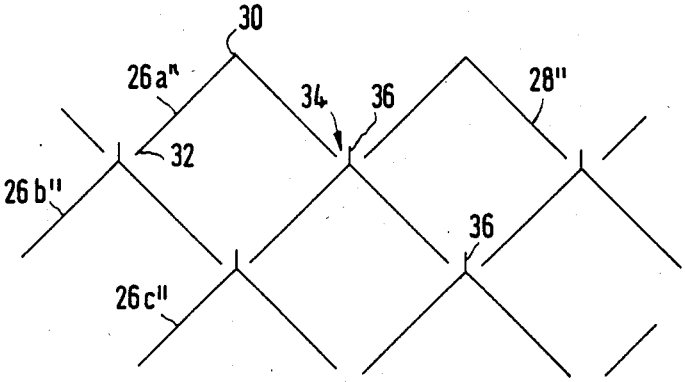
FIG. 5 is a schematic diagram of a third embodiment of an imaging dynodes arrangement according to the invention.
Figure 6:
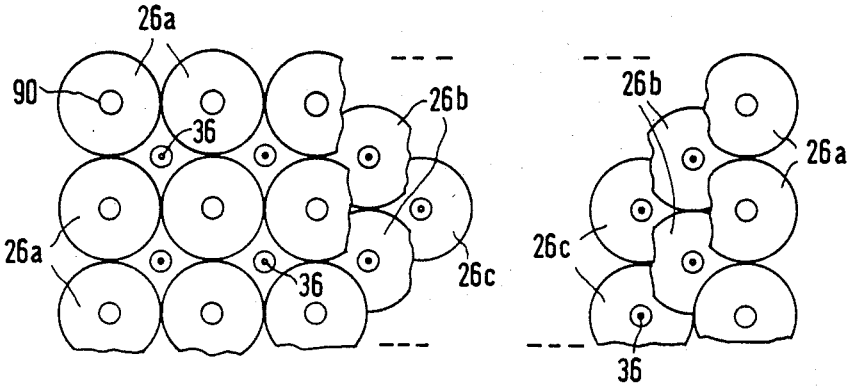
FIG. 6 is a top view of an imaging dynodes arrangement, partly broken away to show all dynodes; the dynode pattern corresponds to that of FIG. 3.

In FIG. 5 the cone tips 30 of cones 28'' of the dynodes 26a''–26n'' merge under an angle which is the same as that one of the cone shells.

The dynodes can be made from CuBe, Ni (later Ag plated) or other suitable vacuum metals on which a secondary emitting surface can be depositied or activated. They can be fabricated from solid material by laser machining, spark discharge machining, or even drilling. The cavities can also be made by chemical etching. An alternative, and less costly fabrication, uses thin sheet formed by a punch-and-pierce method.

The extraction points can be mechanical fitted in small holes. They need not be good secondary emitters as they will likely not intercept many primary electrons owing to the finite angular momentum of the electrons about the axis of the point and the energetic (~5 eV most probable emission energy) of the secondary electrons from the preceding imaging dynodes.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed is:

1. An imaging dynodes arrangement for an electron multiplier, comprising:

(a) a first imaging dynode having a first set of dynode cones with a cone tip and a cone base, the dynode cones of the first set being connected with each other such that they form free cavities therebetween;

(b) a second imaging dynode having a second set of dynode cones with a cone tip and a cone base, the dynode cones of the second set being connected with each other such that they form free cavities therebetween; and (c) needle-shaped extraction points arranged at the cone tips of at least the dynode cones of the second set;

wherein the second imaging dynode is mounted beneath the first imaging dynode in a staggered position such that the cone tips of the dynode cones of the second set are seated beneath the cavities of the first imaging dynode, directing the needle-shaped extraction points towards the cavities.

2. The dynodes arrangement according to claim 1, wherein the needle-shaped extraction points protrude into the cavities.

3. The dynodes arrangement according to claim 1, wherein one needle-shaped extraction point is arranged at each cone tip of the dynode cones of the second set.

4. The dynodes arrangement according to claim 3, wherein each cone tip comprises a flat area and wherein the corresponding needle-shaped extraction poit is positioned in the middle of the flat area.

5. The dynodes arrangement according to claim 1, comprising an additional number of imaging dynodes, each having dynode cones with a cone tip and a cone base and each incorporating a needle-shaped extraction point on the tip of each dynode cone, wherein all additional imaging dynodes are arranged in a pattern one beneath the other and beneath the second dynode in staggered positions such that the needle-shaped extraction points of an imaging dynode are seated beneath to the cavities of the overlying imaging dynode.

6. A photomultiplier tube, comprising:

(a) a photocathode;

(b) an anode; and (c) an imaging dynodes arrangement between the photocathode and the anode including (c1) a first imaging dynode having a first set of dynode cones with a cone tip and a cone base, the dynode cones of the first set being connected with each other such that they form free cavities therebetween;

(c2) a second imaging dynode having a second set of dynode cones with a cone tip and a cone base, the dynode cones of the second set being connected with each other such that they form free cavities therebetween; and (c3) needle-shaped extraction points arranged at the cone tips of at least the dynode cones of the second set;

wherein the second imaging dynode is mounted beneath the first imaging dynode in a staggered position such that the cone tips of the dynode cones of the second set are seated beneath the cavities of the first imaging dynode, directing the needle-shaped extraction points towards the cavities.

7. A scintillatoin gamma camera, comprising:

(a) a scintillation crystal;

(b) a number of photomultiplier tubes mounted behind the scintillation crystal, wherein each photomultiplier tube having (b1) a photocathode;

(b2) an anode; and (b3) an imaging dynodes arrangement between the photocathode and the anode including (b31) a first imaging dynode having a first set of dynode cones with a cone tip and a cone base, the dynode cones of the first set being connected with each other such that they form free cavities therebetween;

(b32) a second imaging dynode having a second set of dynode cones with a cone tip and a cone base, the dynode cones of the second set being connected with each other such that they form free cavities therebetween; and (b33) needle-shaped extraction points arranged at the cone tips of at least the dynode cones of the second set;

wherein the second imaging dynode is mounted beneath the first imaging dynode in a staggered position such that the cone tips of the dynode cones of the second set are seated beneath the cavities of the first imaging dynode, directing the needle-shaped extraction points towards the cavities.

8. A single tube scintillation gamma camera comprising:

(a) a scintillation crystal;

(b) a photocathode associated with the scintillation crystal;

(c) an anode; and (d) an imaging dynodes arrangement between the photocathode and the anode including (d1) a first imaging dynode having a first set of dynode cones with a cone tip and a cone base, the dynode cones of the first set being connected with each other such that they form free cavities therebetween;

(d2) a second imaging dynode having a second set of dynode cones with a cone tip and a cone base, the dynode cones of the second set being connected with each other such that they form free cavities therebetween; and (d3) needle-shaped extraction points arranged at the cone tips of a least the dynode cones of the second set;

wherein the second imaging dynode is mounted beneath the first imaging dynode in a staggered position such that the cone tips of the dynode cones of the second set are seated beneath the cavities of the first imaging dynode, directing the needle-shaped extraction points towards the cavities.

* * * * *